US006860708B2

(12) United States Patent
Lindquist

(10) Patent No.: US 6,860,708 B2
(45) Date of Patent: Mar. 1, 2005

(54) AUTOMATIC DOWN-STACKING TECHNOLOGY

(75) Inventor: David Allen Lindquist, Deerwood, MN (US)

(73) Assignee: Graphic Packaging International, Inc, Marietta, GA (US)

( * ) Notice: Subject to any disclaimer, the term of this patent is extended or adjusted under 35 U.S.C. 154(b) by 224 days.

(21) Appl. No.: 10/198,399

(22) Filed: Jul. 18, 2002

(65) Prior Publication Data

US 2004/0028517 A1 Feb. 12, 2004

(51) Int. Cl.[7] ..... B65H 31/10
(52) U.S. Cl. ..... 414/792.7; 271/217; 414/926
(58) Field of Search ..... 271/217–219; 414/792.7, 792.9, 793, 793.1, 794.4, 923, 924, 925, 926

(56) References Cited

U.S. PATENT DOCUMENTS 3,586,314 A 6/1971 Samoggia
3,716,226 A 2/1973 Kistner
3,880,297 A * 4/1975 Martin ..... 414/793
3,905,595 A * 9/1975 Adams et al. ..... 271/217
3,937,456 A * 2/1976 Gruodis et al. ..... 271/278
5,143,510 A 9/1992 Takamura et al.
5,244,340 A 9/1993 Pizzi et al.
5,558,318 A * 9/1996 Crowley et al. ..... 270/39.05
5,899,341 A 5/1999 Irita

FOREIGN PATENT DOCUMENTS

JP 59133161 A * 7/1984 ..... B65H/31/16

* cited by examiner

*Primary Examiner*—Janice L. Krizek
(74) *Attorney, Agent, or Firm*—Skinner & Associates; Steve M. McLary; Barry Biddle

(57) ABSTRACT

A stacked articles accumulating apparatus functions by down-stacking. The apparatus includes a surface supported on an air cylinder member with a solenoid valve controlled by a photo eye sensor to release air from the cylinder member to maintain the top article of an accumulating articles stack on the support surface substantially at a predetermined elevation. Additional components include a limit switch for setting a minimum elevation of the support surface, a compressed air source supplying the air cylinder member, and an article supply mechanism. A method of article accumulation at substantially a predetermined level is also disclosed.

19 Claims, 2 Drawing Sheets

AUTOMATIC DOWN-STACKING TECHNOLOGY

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to article handling and processing. More particularly, the invention relates to stacking of articles. Most particularly, the invention relates to a system, apparatus and method for automatically down-stacking a number of articles at a predetermined level.

2. Background Information

The background technology, in general, includes apparatus and methods for transferring and stacking articles. This technology is believed to have significant limitations and shortcomings, including but not limited to:

a. the complex mechanical devices used for transferring and stacking articles; and b. the expense involved in the elements that are required to accomplish the specific desired functions.

For this and other reasons, a need exists for the present invention.

The invention provides an automatic down-stacking apparatus which is believed to fulfill the need and to constitute an improvement over the background technology.

All US patents and patent applications, and all other published documents mentioned anywhere in this application are incorporated by reference in their entirety.

BRIEF SUMMARY OF THE INVENTION

The present invention provides an apparatus and method for accumulating stacked articles.

In one embodiment, the apparatus includes a support surface for articles, or article support, with a means, for example pneumatic, for adjusting the support surface elevation. A sensor, for example a photoeye, for detecting a top article of an accumulating articles stack on the support surface is present. A controller is operatively connected to the adjustment means and is responsive to the sensor for adjusting the support surface elevation to maintain the top article of the accumulating articles stack thereon at a selected elevation. Additional components include a second sensor for detecting the support surface elevation and a compressed air source supplying the pneumatic adjustment means for adjusting the support surface elevation.

The support surface is supported on an air cylinder member with a solenoid valve controlled by the sensor to release air from the cylinder member to maintain the top article of an accumulating articles stack on the support surface at a selected elevation. Additional components include a limit switch for setting a minimum elevation of the support surface and a compressed air source supplying the air cylinder member.

In another embodiment, the method includes the steps of supplying, for example consecutively, a plurality of articles at a predetermined point and elevation, which accumulate in a stack, supporting accumulating articles on a surface, adjusting the elevation of the support surface, detecting a top article of the accumulating articles stacked on the support surface, controlling the support surface elevation to maintain the top article of the accumulating articles stacked thereon at a selected elevation.

The features, benefits and objects of the invention will become clear to those skilled in the art by reference to the following description, claims and drawings.

DETAILED DESCRIPTION

Figure 1:
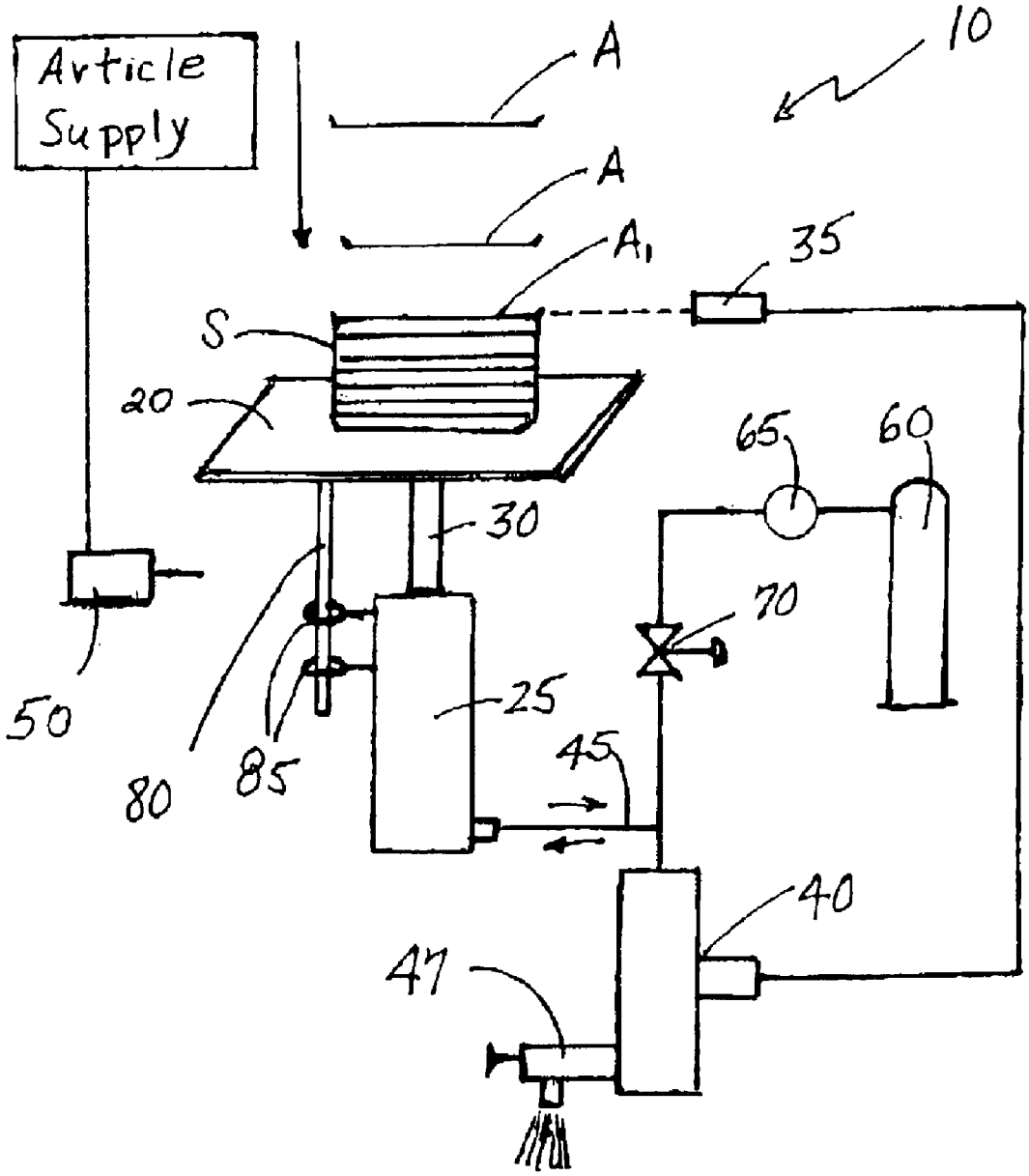
FIG. 1 is a schematic representation of the stacked articles accumulating apparatus of the present invention.

FIG. 1 shows an embodiment of the present invention, generally indicated by the reference numeral 10. The stacked articles accumulating apparatus 10 is described below, first in terms of its major structural elements and then in terms of its secondary structural and/or functional elements that cooperate to perform the stacking function.

Referring to FIG. 1, the present invention is an apparatus and method for stacking a plurality of articles A in a readily controlled manner. The stacked articles accumulating apparatus 10 comprises an article support surface 20 for articles that is mounted to a power mechanism, such as an air cylinder member 25 having an extendable rod 30 secured to the support surface 20, for adjusting the support surface elevation. The power mechanism may alternatively be pneumatic, hydraulic, mechanical, magnetic or electrical mechanism. The air cylinder member rod 30 is extended fully, or substantially, to begin the stacking process, with the rod 30 retracting into the cylinder member 25 as stacking progresses. Articles A are stacked on the support surface 20 by a placing or other process. A sensor, such as a photo eye 35, functions to detect a top article $A_1$ of an accumulating articles stack S on the support surface 20, with the sensor means positioned at a predetermined elevation. A controller, preferably a solenoid valve 40 in combination with a flow control valve 47, is communicatively connected to the air cylinder member 25, with the solenoid valve 40 and flow control valve 47, which is communicatively connected to the photo eye 35, for adjusting the support surface elevation to maintain the top article $A_1$ of the accumulating articles stack S thereon at the predetermined elevation of the sensor means 35. As the articles stack S increases in elevation with each article A placed atop the stack S, the photo eye 35 detects the top article $A_1$ when it reaches the elevation of the photo eye 35. The photo eye 35 signals the solenoid valve 40 to open and allow air to escape, via the flow control valve 47, from the cylinder member 25, preferably via a conduit 45 there between, to retract the cylinder rod 30, thereby lowering the support surface 20 and the accumulating article stack S disposed thereon. The lowering of the elevation of the top article $A_1$ below the elevation of the photo eye 35 causes the sensor 35 to signal the solenoid valve 40 to close and stop the retraction of the cylinder rod 30. As additional articles A are added to the stack S, the height of the stack S increases until a new top article $A_1$ again reaches the elevation of the photo eye 35, and the support surface 20 elevation downward adjustment process again occurs. Eventually, the cylinder rod 30 of the cylinder member 25 retracts completely, or nearly so, and the accumulation of articles A on the articles stack S ceases.

In order to more precisely control the rate of retraction of the cylinder rod 30, and the associated support surface 20, the solenoid valve includes, in combination, an exit flow control valve 47 to control the rate of escape of air from the cylinder member 25. Preferably, the flow control valve 47 is adjustable so that the stacked articles accumulating apparatus 10 can accumulate stacks ($S_x$, $S_y$, $S_z$) of articles ($A_x$, $A_y$, $A_z$) having a wide range of weights. However, the flow control valve setting need not be adjusted during the accumulation of a stack $S_x$ of articles $A_x$ having essentially identical weights.

Although the article sensor means is described as a photo eye, various alternative article sensor means, such as an electromechanical limit switch, optical sensor, infrared sensor, capacitive proximity switch or the like, may be employed with equivalent results. Likewise, the control means operatively connected to the pneumatic means is described as a solenoid valve in combination with a flow control valve, although various alternative electrical or mechanical control means may be employed with equivalent results.

In further embodiments of the invention, a second sensor, such as a limit switch 50, detects the elevation of the support surface 20 at a lower limit, such as the complete, or near complete, retraction of the cylinder rod 30. The limit switch 50 then signals the placement of articles on the stack S to cease. The articles stack S is then removed from the support surface 20, either manually or by automatic means, and the air cylinder rod 30 is extended by compressed air from a compressed air source 60. The compressed air passes through a regulator 65 and a valve 70, which may be operated manually or automatically, and through the conduit 45 to extend the cylinder rod 30 and raise the support surface 20 to the desired starting elevation. It may be advantageous to provide an alignment shaft 80, secured to the support surface 20 and extending parallel to the air cylinder member 25, to provide stability for the support surface 20. The alignment shaft 80 travels in the shaft guides 85, preferably secured to the air cylinder member 25, as illustrated in FIG. 1. Although the support surface sensor means is described as a limit switch, various alternative sensor means, such as a photo eye, may be employed with equivalent results.

Figure 2:
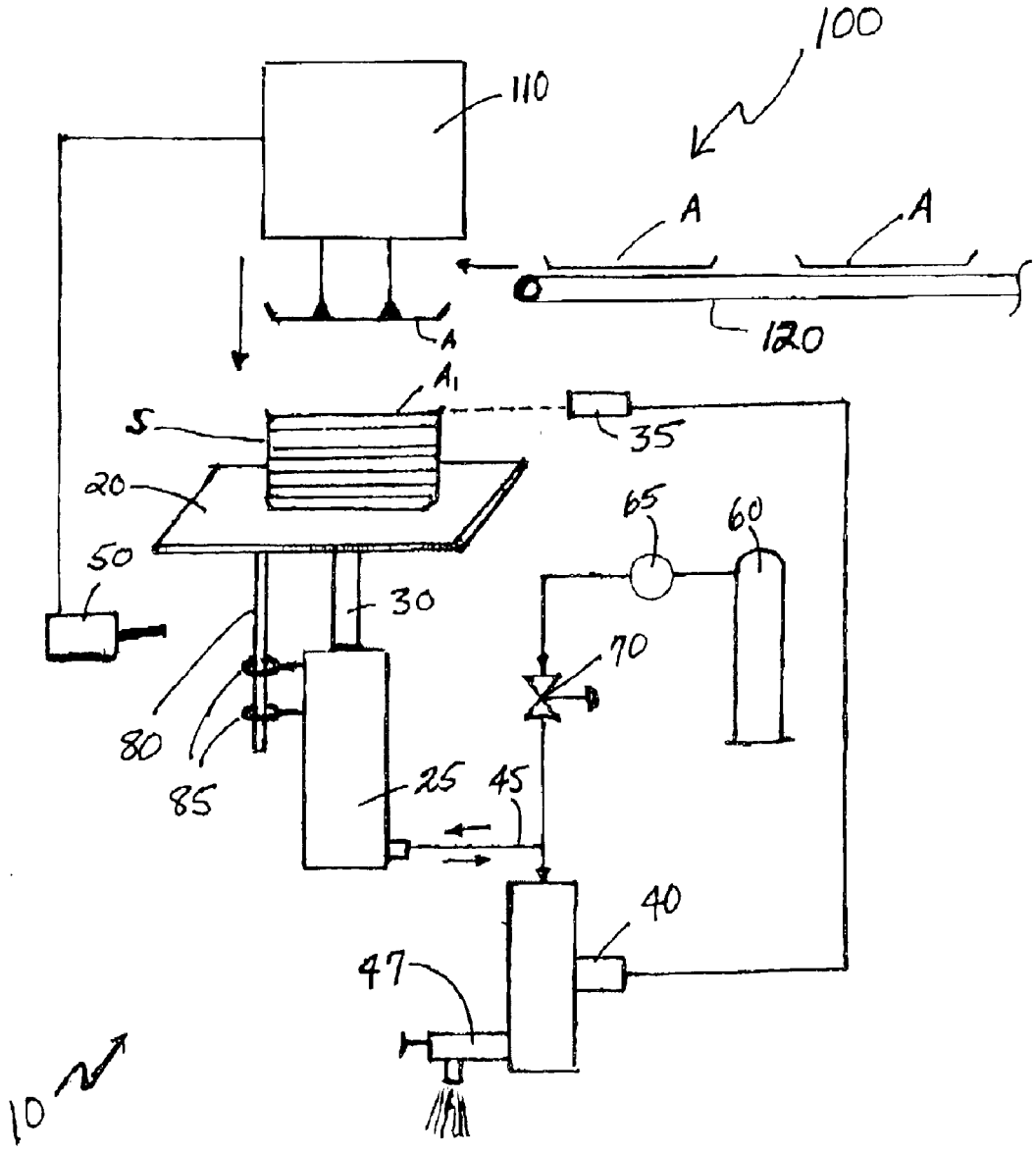
FIG. 2 is a schematic representation of the stacked articles accumulating apparatus cooperating with an article delivery device for transferring, placing and stacking articles.

Referring to FIG. 2, the stacked articles accumulating apparatus 10 functions cooperatively with an article delivery device 110 to provide a system 100 for transferring, placing and stacking articles on a support surface. The article delivery device 110 can be a reciprocating motion pick and place device, or a rotary motion pick and place device. Exemplary rotary motion pick and place devices are described in U.S. Pat. Nos. 4,643,633; 4,901,843; 5,704,758 and 6,273,242, owned by Riverwood International Corporation. The article delivery device 110 repeatedly picks an article A from a source, such as a conveyor 120 or magazine (not shown), and places the article A at a selected elevation atop the accumulating articles stack S on the support surface 20. Of course, one article A is placed directly on the support surface 20 to commence formation of the articles stack S. The stacked articles accumulating apparatus 10 functions as described above to form an articles stack S of the desired size where the level of placement of the top article $A_1$ remains substantially constant. The article delivery device 110 can be manually controlled to cease operation when the cylinder rod 30 has nearly fully or fully retracted, or interfaced with the second sensor means limit switch 50 to cease operation when the support surface 20 reaches a minimum elevation, for automatically controlled operation.

Also disclosed is a method for accumulating stacked articles comprising the steps of supplying articles, for example via an article delivery device 110, supporting articles, for example via the support surface 20, adjusting the support level elevation, for example via the air cylinder 25, detecting a top article $A_1$ of an accumulating articles stack S on or at the support level, for example via the sensor 35, and adjusting the support level elevation, for example via the controller 40, to maintain the top article $A_1$ of the accumulating article stack S thereon at a predetermined elevation.

Further disclosed is a method for delivering articles and accumulating stacked articles comprising the steps of supplying articles, for example via an article delivery device 110, supporting articles, for example via the support surface 20, adjusting the support level elevation, for example via the air cylinder 25, detecting a top article $A_1$ of an accumulating articles stack S on or at the support level, for example via the sensor 35, adjusting the support level elevation, for example via the controller 40, to maintain the top article $A_1$ of the accumulating articles stack S thereon at a predetermined elevation, and transferring and placing articles atop the accumulating articles stack S by the delivery device.

The descriptions above and the accompanying drawings should be interpreted in the illustrative and not the limited sense. While the invention has been disclosed in connection with an embodiment or embodiments thereof, it should be understood that there may be other embodiments which fall within the scope of the invention as defined by the claims. Where a claim, if any, is expressed as a means or step for performing a specified function, it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A stacked article accumulating apparatus comprising:

(a) an article support;

(b) means for adjusting the article support elevation, comprising an air cylinder;

(c) a sensor for detecting a top article of accumulating articles stacked on the article support;

(d) a controller operatively connected to the means for adjusting and responsive to the sensor for adjusting the article support elevation to substantially maintain the top article of the accumulating articles stacked on the article support at a predetermined elevation, the controller comprising a solenoid valve in fluid communication with the air cylinder, the solenoid valve being energized to allow air to escape the cylinder to maintain the top article of the accumulating articles stacked at a predetermined elevation on the article support; and (e) a flow control valve in combination with the solenoid valve, the flow control valve controlling the rate of escape of air from the air cylinder.

2. The stacked article accumulating apparatus of claim 1, wherein the air cylinder member includes a retractable rod to maintain the top article of the accumulating articles stack on the article support at a predetermined elevation.

3. The stacked article accumulating apparatus of claim 1, wherein the sensor comprises a photo eye for detecting the top article of the accumulating article stack.

4. The stacked article accumulating apparatus of claim 1, wherein the controller comprises a solenoid valve in fluid communication with the adjusting means, the solenoid valve responsive to the sensor for adjusting the article support elevation.

5. The stacked article accumulating apparatus of claim 1, further comprising a compressed air source supplying the article support elevation adjusting means.

6. The stacked article accumulating apparatus of claim 1, further comprising a second sensor connected to an article delivery device for detecting the article support elevation.

7. The stacked article accumulating apparatus of claim 6, wherein the second sensor detects a minimum elevation of the article support.

8. The stacked article accumulating apparatus of claim 7, wherein the second sensor is a limit switch.

9. A stacked article accumulating apparatus comprising:

(a) an article support;

(b) an air cylinder for adjusting the article support elevation;

(c) a sensor means for detecting a top article of accumulating articles stacked on the article support; and (d) a controller operatively connected to the means for adjusting and responsive to the sensor for adjusting the article support elevation to substantially maintain the top article of the accumulating articles stacked on the article support at a predetermined elevation, the controller comprising a solenoid valve in fluid communication with the air cylinder, the solenoid valve energized to allow air to escape the cylinder to maintain the top article of the accumulating articles stacked on the article support at a predetermined elevation; and (e) a flow control valve in combination with the solenoid valve, the flow control valve controlling the rate of escape of air from the air cylinder.

10. The stacked article accumulating apparatus of claim 9, wherein the air cylinder member includes a retractable rod to maintain the top article of the accumulating articles stacked on the article support at a predetermined elevation.

11. The stacked article accumulating apparatus of claim 9, wherein the sensor comprises a photo eye for detecting the top article of the accumulating article stack.

12. The stacked article accumulating apparatus of claim 9, wherein the controller comprises a solenoid valve in fluid communication with the power mechanism, the solenoid valve responsive to the sensor for adjusting the article support elevation.

13. The stacked article accumulating apparatus of claim 9, further comprising a compressed air source supplying the air cylinder.

14. The stacked article accumulating apparatus of claim 9, further comprising a second sensor connected to an article delivery device for detecting the article support elevation.

15. The stacked article accumulating apparatus of claim 14, wherein the second sensor detects a minimum elevation of the article support.

16. The stacked article accumulating apparatus of claim 15, wherein the second sensor is a limit switch.

17. A stacked article accumulating apparatus comprising:

(a) an article support;

(b) an air cylinder member for adjusting the article support elevation;

(c) a sensor for detecting a top article of accumulating articles stacked on the article support;

(d) a controller operatively connected to the air cylinder member and responsive to the sensor for adjusting the article support elevation to substantially maintain the top article of the accumulating articles stacked on the article support at a predetermined elevation;

(e) a second sensor connected to an article delivery device for detecting a minimum elevation of the article support; and (f) a compressed air source supplying the air cylinder member.

18. A stacked article accumulating apparatus comprising:

(a) an article support;

(b) means for adjusting the article support elevation;

(c) a sensor for detecting a top article of accumulating articles stacked on the article support;

(d) a controller operatively connected to the means for adjusting and responsive to the sensor for adjusting the article support elevation to substantially maintain the top article of the accumulating articles stacked on the article support at a predetermined elevation; and (e) a compressed air source supplying the article support elevation adjusting means.

19. A stacked article accumulating apparatus comprising:

(a) an article support;

(b) a power mechanism for adjusting the article support elevation;

(c) a sensor means for detecting a top article of accumulating articles stacked on the article support;

(d) a controller operatively connected to the means for adjusting and responsive to the sensor for adjusting the article support elevation to substantially maintain the top article of the accumulating articles stack on the article support at a predetermined elevation; and (e) a compressed air source supplying the power mechanism.

* * * * *